US006308926B1

(12) United States Patent
Meyer

(10) Patent No.: US 6,308,926 B1
(45) Date of Patent: Oct. 30, 2001

(54) GROUND EMBEDDING POST HOLDER WITH ADJUSTABLE BRACKET

(75) Inventor: George Meyer, Ontario (CA)

(73) Assignee: Royal Capital Stamping & Tooling Ltd., Etobicoke ( * ) Notice: Subject to any disclaimer, the term of this patent is extended or adjusted under 35 U.S.C. 154(b) by 0 days.

(21) Appl. No.: 09/425,111

(22) Filed: Oct. 19, 1999

(51) Int. Cl.[7] ..... F16M 13/00
(52) U.S. Cl. ..... 248/530; 248/545
(58) Field of Search ..... 248/530, 156, 248/218.4, 519, 532, 533, 545

(56) References Cited

U.S. PATENT DOCUMENTS 844,726 * 2/1907 Hunger ..... 111/99
3,817,394 * 6/1974 Saiki ..... 211/110
4,588,157 * 5/1986 Mills ..... 248/545
4,846,499 * 7/1989 Izumi et al. ..... 280/830
4,874,149 * 10/1989 Miceli ..... 248/530
5,709,366 * 1/1998 Speece ..... 248/530
5,884,874 * 3/1999 Speece et al. ..... 248/516
6,039,298 * 3/2000 Stier ..... 248/545

* cited by examiner

*Primary Examiner*—Anita King

(57) ABSTRACT

A post holder is formed by a post receiving bracket fitted to a spike which embeds into a ground supporting surface. The bracket, which is located above ground level, has a base part secured to the spike, a first bracket part which is fixedly attached to the base part and a second bracket part free of the base part and adjustably secured at spaced apart locations to the first bracket part.

1 Claim, 3 Drawing Sheets

7
5
5
7
3
3
1

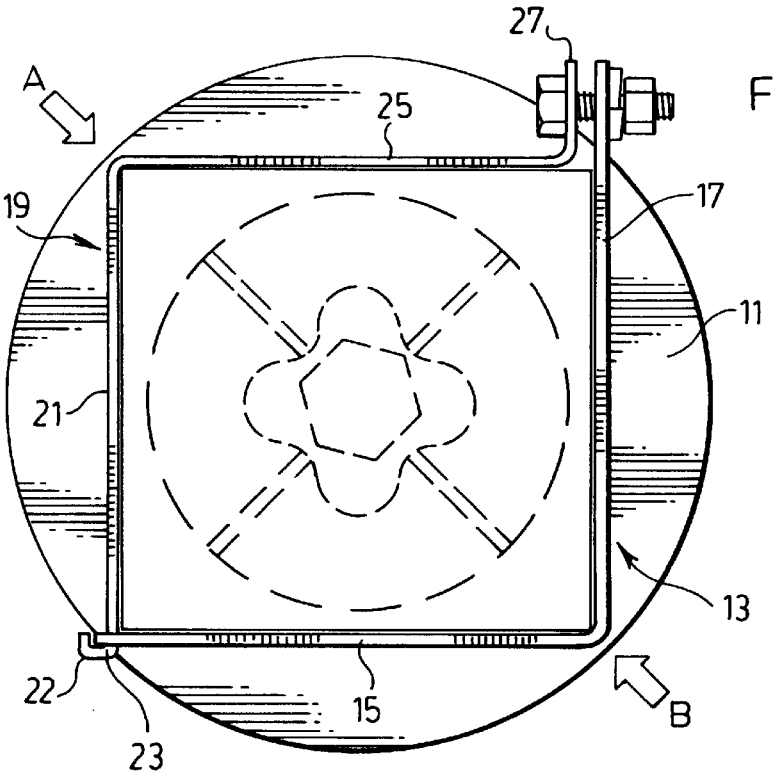
FIG. 3.
FIG. 4.
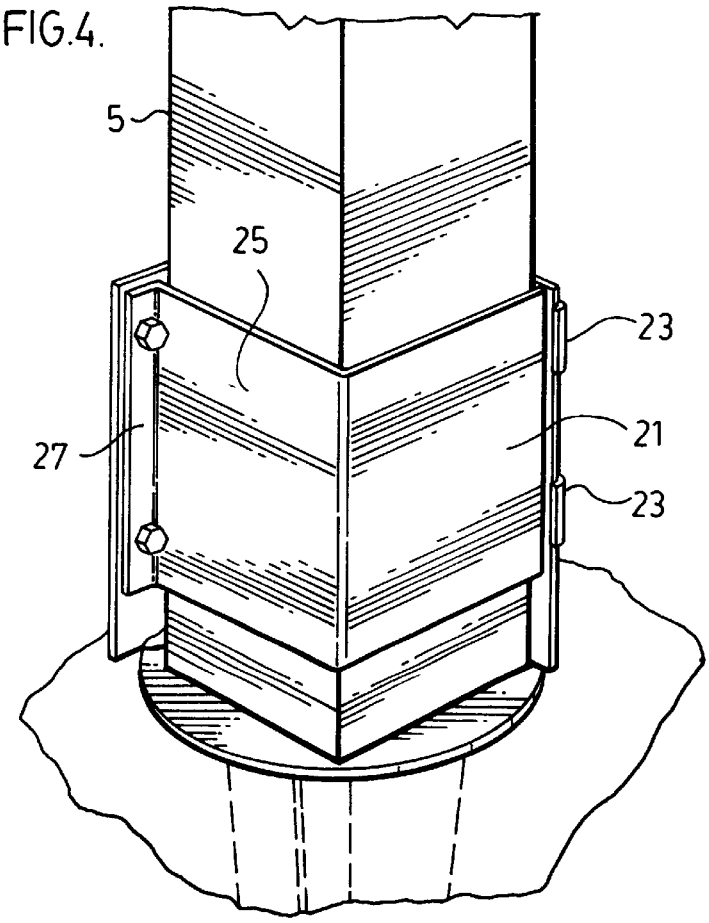

GROUND EMBEDDING POST HOLDER WITH ADJUSTABLE BRACKET

FIELD OF THE INVENTION

The present invention relates, in general, to a post holder having a ground embedding spike and an upper bracket for receiving the base of a post. In particular, the present invention relates to an adjustable bracket on a post holder of the type described immediately above.

BACKGROUND OF THE INVENTION

In the past, the standard method of putting up a fence is to first mount the fence posts by embedding the base of the posts in concrete supports dug into the ground.

Recently fence posts mounts which spike into the ground have been made available eliminating the requirement for underground cement supports. These spikes include brackets which sit above ground level for receiving the bottom ends of the fence posts.

The known spike bracket, which has a metallic construction, is pre-shaped to generally match with the configuration of the fence post, e.g. a rectangular bracket for receiving a rectangular fence post. Again, the known bracket has a one piece construction open along one side for opening and closing the bracket around the fence post and then using adjustable tightening members typically nuts and bolts for closing the one open side of the bracket.

Often times there is a substantial discrepancy in the size of the fence post and the size of the opening formed by the bracket. This requires a substantial deformation of the one piece bracket at a single location, i.e. the one open side, in order to properly secure the bracket to the fence post. Typically, such deformation requires bending of the bracket and produces small area point contacts with the fence post. This results in a less then optimal securing action which may result in movement of the fence post under load.

SUMMARY OF THE PRESENT INVENTION

The present invention provides a post holder which has an upper bracket portion specifically designed to provide a very positive securing of the base of a post such as a fence post. This upper bracket portion is connected to a bottom spike portion which is to be embedded into a ground support for the post holder.

In accordance with the present invention, the bracket portion of the post holder has a base part secured to the spike, a first bracket part attached to the base part, and a second bracket part which is not attached to the base part but rather which is adjustably secured at spaced apart locations to the first bracket part.

As a result of the two piece construction of the bracket, i.e. as a result of it being formed by two bracket parts, one of which is freely adjustable, tightening of the bracket does not produce unwanted bending at a single location but rather causes movement of the entire freely movable bracket part. This in turn enables the bracket to accommodate for a substantial tolerance between its size and the size of the post. In addition, the provision of a freely movable bracket part produces substantial surface area contact between it and the post upon tightening of the bracket.

BRIEF DESCRIPTION OF THE DRAWINGS

The above as well as other advantages and features of the present invention will be described in greater detail according to the preferred embodiments of the present invention in which;

FIG. 3 is a plan view looking down on the fence post holder of FIG. 2 when in its closed position;

FIG. 4 is a perspective view showing the fence post holder of FIG. 2 when wrapped around the bottom of the fence post.

DETAILED DESCRIPTION ACCORDING TO THE PREFERRED EMBODIMENTS OF THE PRESENT INVENTION IN WHICH

Figure 1:
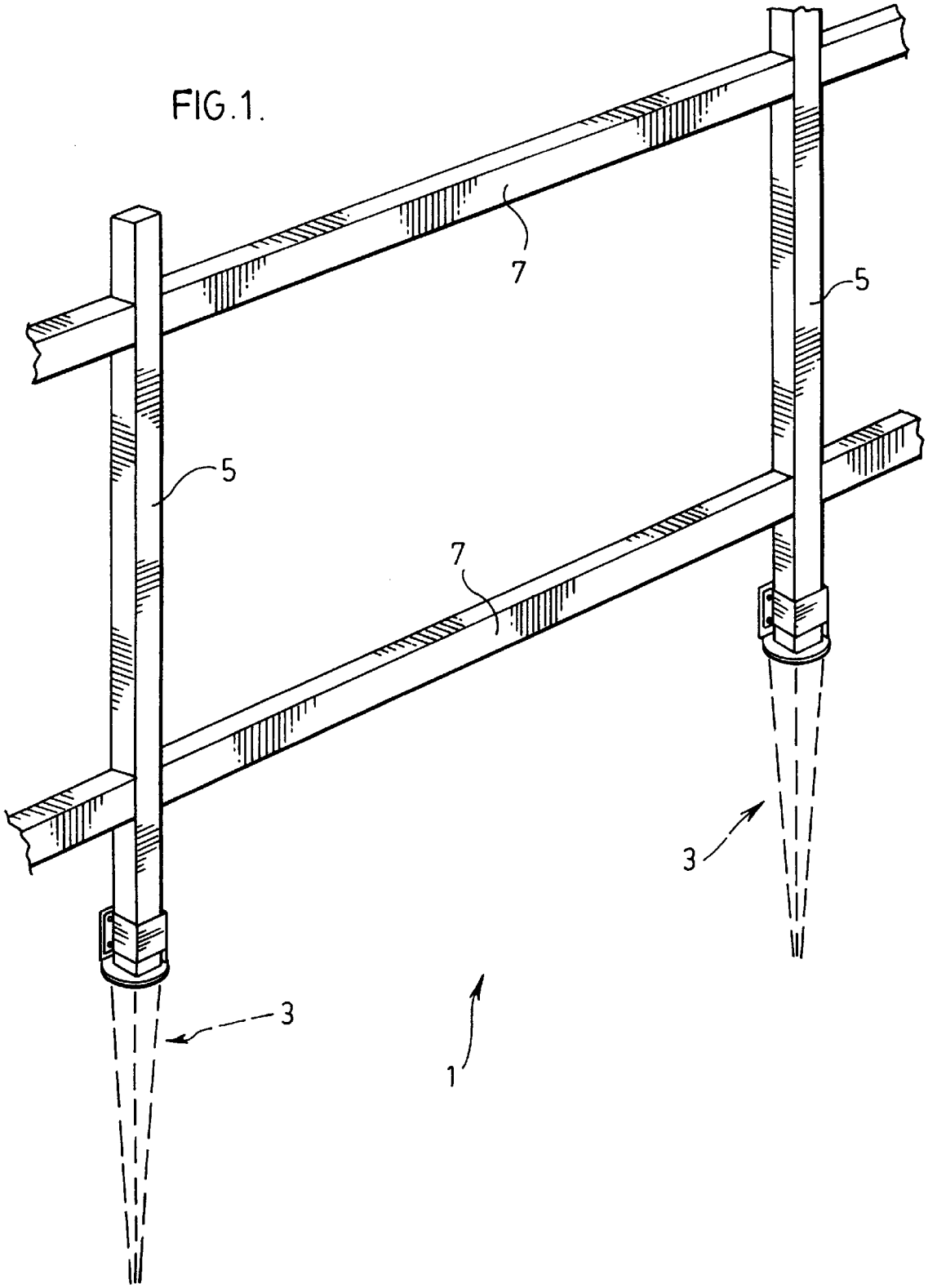
FIG. 1 is a perspective view of a section of a fence supported by fence post holders according to a preferred embodiment of the present invention.

FIG. 1 shows a section of fence generally indicated at 1. This section of fence comprises upright fence posts 5 supporting cross-beams 7 of the fence. The bottom ends of the fence posts 5 are secured to the ground beneath the fence by means of fence post holders generally indicated at 3.

Figure 2:
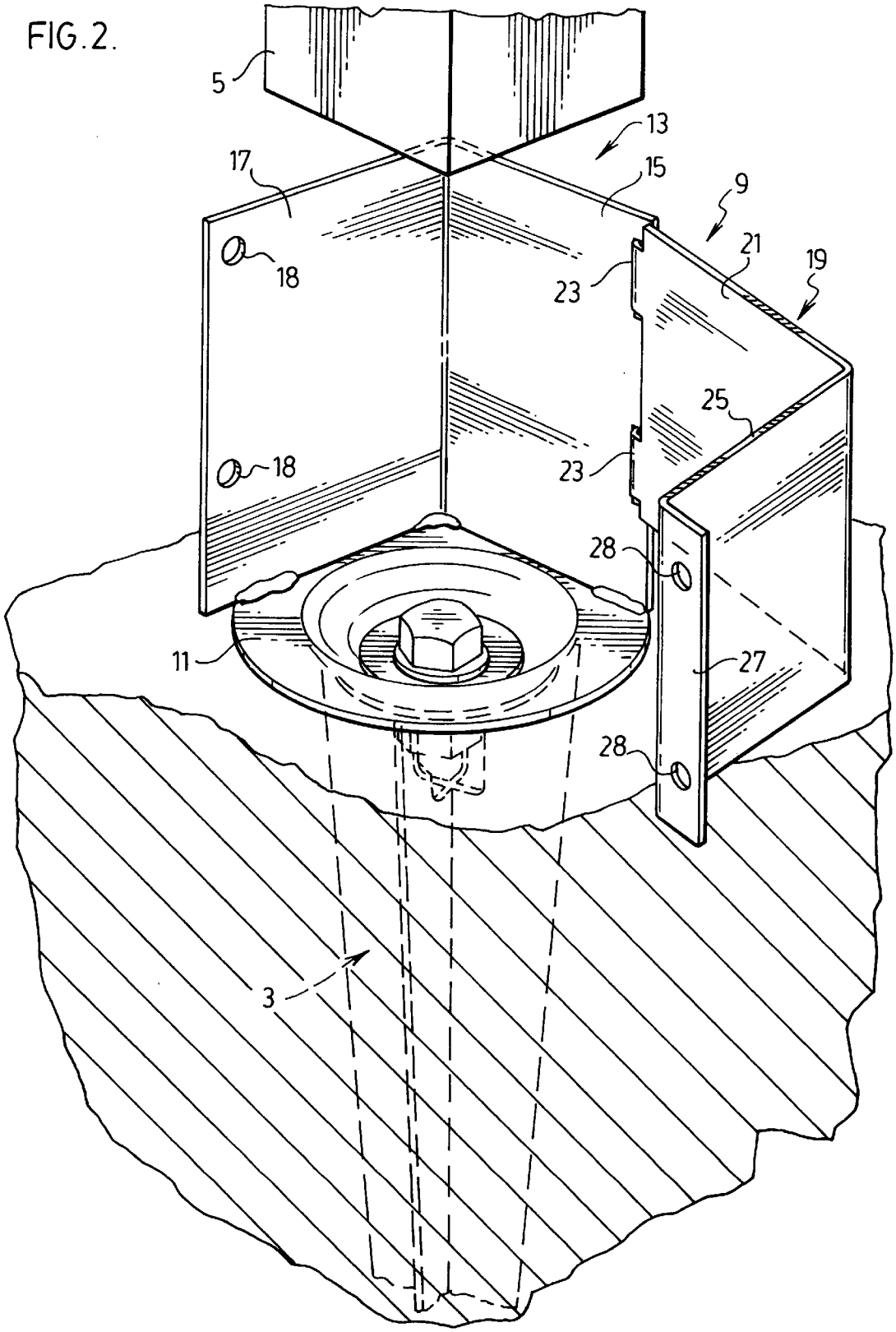
FIG. 2 is an enlarged perspective view of one of the fence post holders of FIG. 1 in an open position ready to receive the bottom of a fence post.

FIG. 2 of the drawings shows that fence post holder 3 comprises a lower spike portion 6 embedded into the ground. An upper bracket portion 9 is secured at its base 11 to spike portion 3.

The bracket portion further includes a first L-shaped bracket member 13 secured directly to the base of the bracket portion. This bracket member has a first panel 15 and a second panel 17. Panel 17 is provided with a pair of openings 18.

The bracket portion further includes a second L-shaped bracket member 19 formed by a first panel 21 and a second panel 25 at right angles to the first panel. Panel 21 is hingedly secured at 23 to panel 15 of the first bracket member.

The second bracket member further includes a flange 27 at the free end of and at right angles to panel 25 of the second bracket member. Flange 27 is provided with openings 28. As can be seen in FIGS. 3 and 4 of the drawings when the two bracket members are closed with one another, the openings 28 in flange 27 align with the openings 18 in panel 17.

FIG. 2 clearly demonstrates the fact that bracket member 19 can be swung completely open relative to bracket member 17. Furthermore, and as will be more apparent in FIG. 3 of the drawings, panel 21 includes hook portions 22 which releasably engage within slots provided on panel 15 of the first bracket member. Accordingly, the second bracket member is not only movable relative to the first bracket member but is also completely detachable therefrom simply by releasing the hinged connection between the two bracket members.

When the two bracket members are opened relative to one another as shown in FIG. 2, the bottom of the fence post 5 is seated atop the base 11 of the bracket portion resting against the two panels 15 and 17 of the first bracket member 13. From here, the second bracket member 19 is swung closed against the as yet uncovered part of the fence post bottom. Securing members in the form of threaded nuts and bolts are then fitted through the aligned openings 18 and 28 of the two bracket parts. These nuts and bolts are then tightened to clamp the bottom of the fence post between the two bracket members.

As a result of the two spaced apart movable connections between the two bracket members and further because the second bracket member is completely free of the base of the bracket portion, tightening of the bolts causes the entirety of bracket member 19 to be drawn against the fence post. The resultant pressure applied on the fence post as indicated by arrows A and B shows that the fence post is clamped across its girth from opposite sides of the bracket portion. This provides a very positive securing action on the fence post holding it against movement even under extremely heavy loads.

As will be understood from the above, the tightening of the two bracket portions produces little or no distortion on either of them but rather because of the free floating nature of the second bracket portion produces a uniform gripping action around the base of the post.

Although various preferred embodiments of the present invention have been described in detail, it will be appreciated by those skilled in the art that variations may be made without departing from the spirit of the invention or the scope of the appended claims.

The embodiment of the invention in which an exclusive property or privilege is claimed are defined as follows:

1. A post holder having a bottom spike portion and an upper post receiving bracket portion, said bracket portion having a base part secured atop said bottom spike portion, a first bracket part having a lower edge attached to said base part and a second bracket part having a lower edge elevated to both the lower edge of the first bracket part and the base part, the second bracket part being adjustably secured at spaced apart locations to said first bracket part and not being secured to said base part such that said second bracket part is freely moveable relative to said base part of said bracket portion.

* * * * *